US009335707B2

(12) United States Patent
Fujiwara et al.

(10) Patent No.: US 9,335,707 B2
(45) Date of Patent: May 10, 2016

(54) IMAGE FORMING APPARATUS FOR CANCELLING NON-UNIFORM ROTATION OF A ROTATING MEMBER

(71) Applicant: Konica Minolta, Inc., Chiyoda-ku (JP)

(72) Inventors: Takashi Fujiwara, Hachioji (JP); Shoichi Yoshikawa, Okazaki (JP); Noboru Oomoto, Toyokawa (JP); Yoshiyuki Toso, Toyokawa (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 19 days.

(21) Appl. No.: 14/030,318

(22) Filed: Sep. 18, 2013

(65) Prior Publication Data

US 2014/0079436 A1 Mar. 20, 2014

(30) Foreign Application Priority Data

Sep. 20, 2012 (JP) ..... 2012-206690

(51) Int. Cl.
*G03G 15/00* (2006.01)

(52) U.S. Cl.
CPC ..... *G03G 15/757* (2013.01)

(58) Field of Classification Search
USPC ..... 399/167
See application file for complete search history.

(56) References Cited

U.S. PATENT DOCUMENTS

| | | | |
|---|---|---|---|
| 2005/0129427 | A1 | 6/2005 | Kinoshita et al. |
| 2009/0245871 | A1 | 10/2009 | Maeda et al. |
| 2009/0322020 | A1 | 12/2009 | Iwata et al. |

FOREIGN PATENT DOCUMENTS

| | | | | |
|---|---|---|---|---|
| JP | 03-155381 | A | | 3/1991 |
| JP | 03-213750 | A | | 9/1991 |
| JP | H05-27417 | U | | 4/1993 |
| JP | 2003-241540 | A | | 8/2003 |
| JP | 2005-176467 | A | | 6/2005 |
| JP | 2005-321476 | A | | 11/2005 |
| JP | 2006-292886 | A | | 10/2006 |
| JP | 2007-240687 | A | | 9/2007 |
| JP | 2009-259224 | A | | 11/2009 |
| JP | 2009-265177 | A | | 11/2009 |
| JP | 2009276650 | A | * | 11/2009 |
| JP | 2010-33002 | A | | 2/2010 |
| JP | 2010-102247 | A | | 5/2010 |

OTHER PUBLICATIONS

Computer translation of JP2007-240687A to Masuda et al., publication date Sep. 20, 2007.*
Notification of Reasons for Rejection dated Dec. 2, 2014 issued in the corresponding Japanese Patent Application No. 2012-206690 and English translation (7 pages).
Official Action issued in corresponding Chinese Patent Application No. 201310428617.9; issued Jul. 24, 2015, and English translation thereof. (14 pages).

* cited by examiner

*Primary Examiner* — Quana M Grainger
(74) *Attorney, Agent, or Firm* — Buchanan Ingersoll & Rooney PC

(57) ABSTRACT

An image forming apparatus having: a rotating member adapted to support an image; a first drive source configured to generate a drive force; a transmission mechanism configured to transmit the generated drive force toward the rotating member, the mechanism including an upstream gear and a downstream gear configured to receive the drive force therefrom; a sensor configured to output a signal indicating a rotational status of the rotating member; a control circuit configured to generate a control signal appropriate for non-uniform rotation of the rotating member, on the basis of the signal outputted by the sensor; and an actuator configured to cause a rotation axis of the first drive source or the transmission mechanism to pivot, in accordance with the control signal, thereby changing a force with which the upstream gear pushes the downstream gear into rotation such that the non-uniform rotation is cancelled out.

7 Claims, 8 Drawing Sheets

IMAGE FORMING APPARATUS FOR CANCELLING NON-UNIFORM ROTATION OF A ROTATING MEMBER

This application is based on Japanese Patent Application No. 2012-206690 filed on Sep. 20, 2012, the content of which is incorporated herein by reference.

BACKGROUND OF THE INVENTION

1. Field of the Invention

The present invention relates to an image forming apparatus including a rotating member adapted to support an image and a transmission mechanism that transmits a drive force generated by a drive source to the rotating member.

2. Description of Related Art

An image forming apparatus as mentioned above is disclosed in Japanese Patent Laid-Open Publication No. 2010-102247, for example. In Japanese Patent Laid-Open Publication No. 2010-102247, the transmission mechanism includes a drum drive gear, a coupling disc, an encoder head, and a control circuit.

The drum drive gear is positioned coaxially with a rotating shaft of a photoreceptor drum, which is an example of the rotating member. The coupling disc engages with the photoreceptor drum and the drum drive gear. The encoder head detects information about the rotation of the coupling disc. The control circuit controls the rotation of the photoreceptor drum on the basis of the rotation information detected by the encoder head.

Here, the drum drive gear and the coupling disc engage with each other via a viscoelastic member. By passive vibration control using the viscoelastic member, a resonant frequency of the photoreceptor drum or the like is shifted from original value, thereby reducing transmissibility of input vibrations having the certain frequency.

However, such passive vibration control simply shifts the resonant frequencies, so that resonance characteristics of other frequency bands (e.g., a low-frequency band) persist. The persistence of the resonance characteristics causes a problem where conventional drive force transmission mechanisms cannot suppress the vibration of the photoreceptor drum (i.e., the rotating member) upon input of vibration that is difficult to predict.

SUMMARY OF THE INVENTION

An image forming apparatus according to an embodiment of the present invention includes: a rotating member adapted to support an image; a first drive source configured to generate a drive force; a transmission mechanism configured to transmit the drive force generated by the first drive source toward the rotating member, the mechanism including an upstream gear and a downstream gear configured to receive the drive force from the upstream gear; a sensor configured to output a signal indicating a rotational status of the rotating member; a control circuit configured to generate a control signal appropriate for non-uniform rotation of the rotating member, on the basis of the signal outputted by the sensor; and an actuator configured to cause a rotation axis of the first drive source or the transmission mechanism to pivot, in accordance with the control signal generated by the control circuit, thereby changing a force with which the upstream gear pushes the downstream gear into rotation such that the non-uniform rotation of the rotating member is cancelled out.

DETAILED DESCRIPTION OF THE PREFERRED EMBODIMENTS

Figure 1:
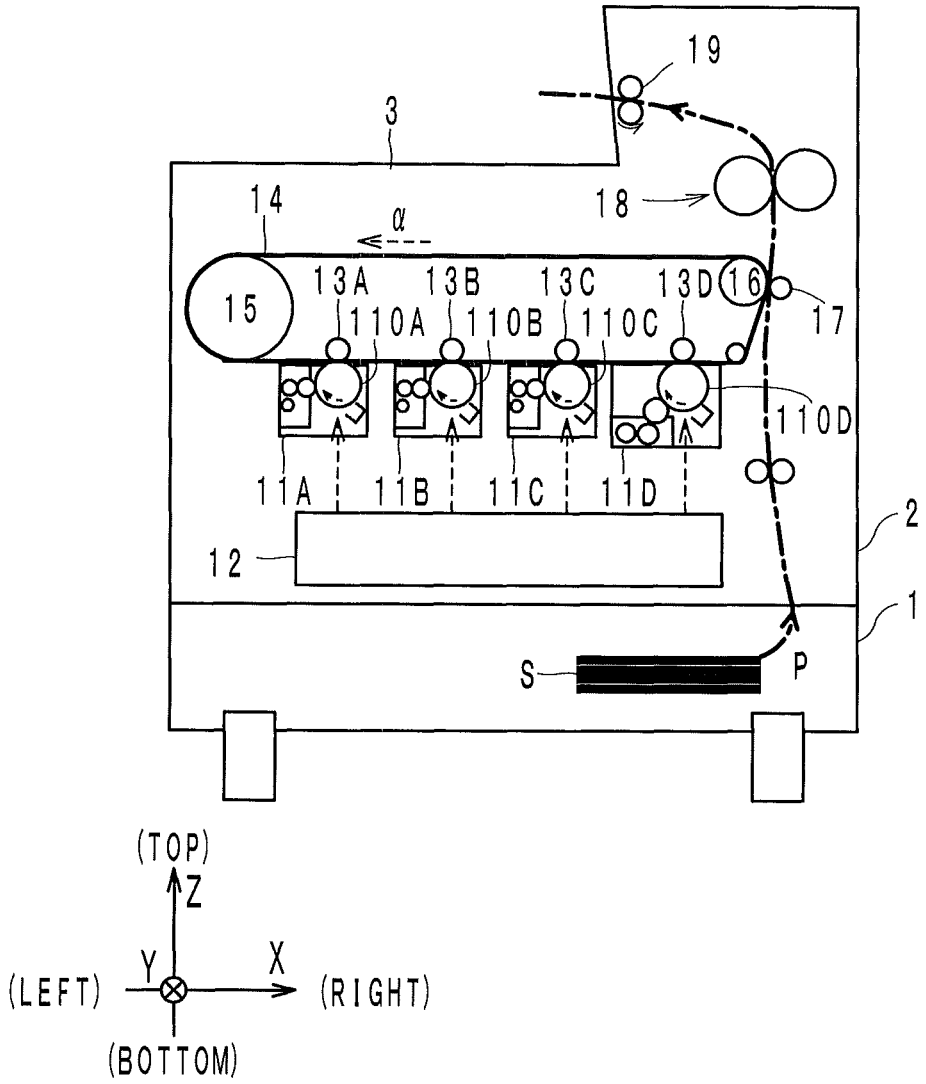
FIG. 1 is a diagram illustrating the configuration of an image forming apparatus according to an embodiment.

Hereinafter, an image forming apparatus according to an embodiment of the present invention will be described.

Preliminary Notes

First, the X-, Y-, and Z-axes shown in some figures will be defined. The X-axis represents the left-right (width) direction of the image forming apparatus, and the Y-axis represents the front-back direction of the image forming apparatus. Moreover, the Z-axis represents the top-bottom (height) direction of the image forming apparatus.

Furthermore, for some components, the suffix A, B, C, or D is assigned at the ends of their reference numerals. The suffixes A, B, C, and D represent yellow (Y), magenta (M), cyan (C), and black (Bk), respectively. For example, an imaging unit 11A is intended to mean an imaging unit 11 for yellow. Moreover, in the case where none of the suffixes is assigned to a reference numeral which can be assigned any one of the suffixes, the reference numeral is intended for collective reference to all colors. For example, an imaging unit 11 is intended to mean an imaging unit for any one of the colors Y, M, C, and Bk.

General Configuration of Image Forming Apparatus

FIG. 1 is a schematic diagram illustrating the configuration of an image forming apparatus according to an embodiment. In FIG. 1, the image forming apparatus is, for example, a multifunction printer (MFP) of a tandem type employing electrophotography, which forms a full-color image on a sheet S (such as paper). To this end, the image forming apparatus generally includes a supply unit 1, an image forming unit 2, and an output tray 3.

The supply unit 1 has unprinted sheets S stacked in an unillustrated supply tray. From the supply tray, the sheets S are fed one by one from the top by a supply roller (not shown) that is rotating, toward the uppermost stream of a feeding path P (see the long dashed short dashed line).

The image forming unit 2 includes imaging units 11A to 11D. The image forming unit 2 further includes a scanning optical system 12, primary transfer rollers 13A to 13D, an intermediate transfer belt 14, rollers 15 and 16, a secondary transfer roller 17, a fusing unit 18, and an ejection roller pair 19.

The imaging units 11 are arranged in the left-right direction immediately below the intermediate transfer belt 14 to be described later. Each imaging unit 11 has a photoreceptor drum 110, which is a typical example of the rotating member. There are arranged different types of components around each photoreceptor drum 110, such that one component from each type is provided, e.g., one charger, one developer, etc., are arranged around the photoreceptor drum 110. Each charger charges the circumferential surface of the photoreceptor drum 110 for its corresponding color. The charged circumferential surface of the photoreceptor drum 110 is irradiated with an optical beam for the corresponding color generated by the scanning optical system 12. As a result, an electrostatic latent image in the corresponding color is formed and supported on the circumferential surface of the photoreceptor drum. The developer supplies toner onto the circumferential surface of the photoreceptor drum for the corresponding color and develops the electrostatic latent image. As a result, a toner image in the corresponding color is formed on the circumferential surface of the photoreceptor drum.

The intermediate transfer belt 14 is stretched around the rollers 15 and 16, etc., in a looped form, so as to contact the circumferential surfaces of the photoreceptor drums. The intermediate transfer belt 14 is rotated in the direction of arrow $\alpha$ by the rollers 15 and 16 being rotated by drive forces provided by unillustrated motors.

Each primary transfer roller 13 is disposed so as to be opposed vertically to the photoreceptor drum for its corresponding color with respect to the intermediate transfer belt 14. The primary transfer roller 13 transfers a toner image supported on the photoreceptor drum for the corresponding color onto the intermediate transfer belt 14 moving in the direction of arrow $\alpha$, approximately in the same position (i.e., primary transfer). Ultimately, a composite toner image (i.e., a full-color image) composed of overlapping toner images in their respective colors is formed on the surface of the intermediate transfer belt 14. Moreover, the composite toner image supported on the intermediate transfer belt 14 is carried to the position of a transfer nip to be described later.

Furthermore, the secondary transfer roller 17 is disposed so as to be opposed to the roller 16 with respect to the intermediate transfer belt 14. The secondary transfer roller 17 and the intermediate transfer belt 14 are in contact with each other so that there is a transfer nip formed therebetween. A sheet S fed by the supply unit 1 as mentioned above is introduced to the transfer nip. Moreover, a transfer bias voltage is applied to the secondary transfer roller 17, so that the composite toner image is attracted to the secondary transfer roller 17 by the transfer bias voltage, and is transferred onto the sheet S introduced to the transfer nip (secondary transfer). The sheet S subjected to the secondary transfer is forwarded from the transfer nip toward the fusing unit 18.

Upon the introduction of the sheet S subjected to secondary transfer, the fusing unit 18 heats and presses the sheet S, thereby fixing the composite toner image on the sheet S. The sheet S subjected to the fixing process is forwarded as a print from the fusing unit 18 being rotated, and thereafter ejected by the ejection roller pair 19 being rotated counterclockwise, into the output tray 3 provided above the image forming unit 2.

First Configuration Example of Drive System

Figure 2:
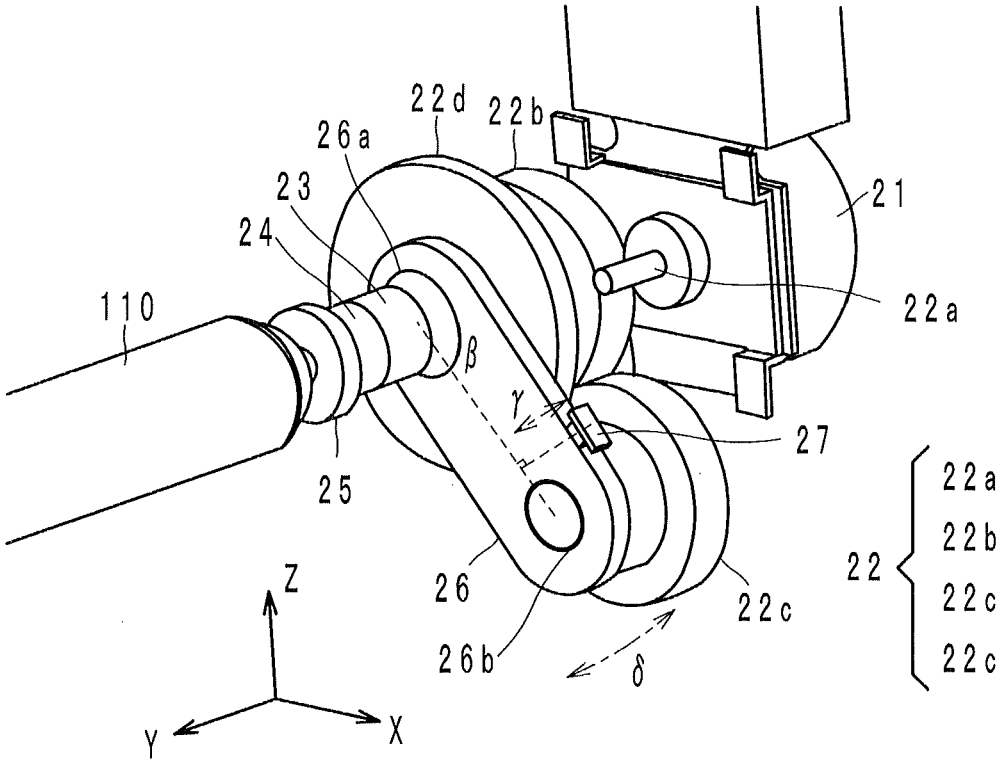
FIG. 2 is an oblique view illustrating a first configuration example of a drive system for a photoreceptor drum in FIG. 1.
Figure 3:
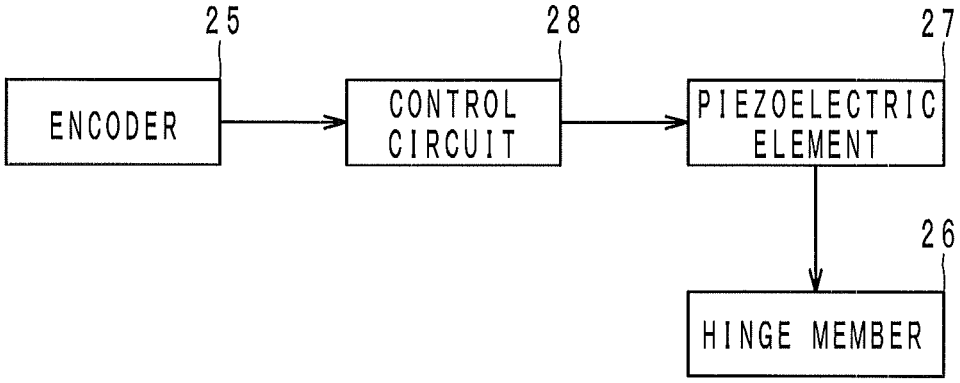
FIG. 3 is a block diagram illustrating the configuration of a substantial part of the drive system in FIG. 2.

FIG. 2 is an oblique view illustrating a first configuration example of a drive system for the photoreceptor drum 110 shown in FIG. 1. FIG. 3 is a block diagram illustrating the configuration of a substantial part of the drive system in FIG. 2.

In FIG. 2, the drive system includes a motor 21, which is a typical example of a first drive source, a transmission mechanism 22, a joint member 23, and a coupling member 24.

The motor 21 is secured to, for example, the frame of the image forming unit 2. The motor 21 rotates its own rotating shaft under control of a control circuit 28.

Note that to reduce the number of parts, in some cases, the motor 21 might be shared between photoreceptor drums 110 for a plurality of colors. In such a case, a drive system for at least one of the colors Y, M, C, and Bk has the configuration shown in FIG. 2, and a drive system for the remaining colors does not have its own motor 21 but receives a drive force from the motor 21 included in the other drive system via gears or the like.

The transmission mechanism 22 consists of a gear 22*a*, which is provided on the rotating shaft of the motor 21, a small-diameter gear 22*b*, a two-stage gear unit 22*c*, and a large-diameter gear 22*d*.

The gear 22*a* is provided on the rotating shaft of the motor 21 so as to rotate in synchronization therewith. As a result, the drive force generated by the motor 21 is inputted to the transmission mechanism 22. The gear 22*a* is provided at the uppermost stream of the transmission mechanism 22, so as to transmit the inputted drive force from the motor 21, toward the downstream. The drive force is used at least for rotating the photoreceptor drum 110 for a corresponding color.

The small-diameter gear 22*b* is provided immediately downstream from the gear 22*a*, so as to mesh with the gear 22*a*. The small-diameter gear 22*b* is rotated about its own shaft by the drive force transmitted from the gear 22*a*.

The two-stage gear unit 22*c* is provided immediately downstream from the small-diameter gear 22*b*, and includes an input gear and an output gear. The input gear and the output gear are provided coaxially. Moreover, in the example illustrated in the figure, the input gear has a larger diameter than the output gear. The input gear meshes with the small-diameter gear 22*b*, and is rotated about the shaft of the two-stage gear unit 22*c* by the drive force transmitted by the small-diameter gear 22*b*. On the other hand, the output gear is rotated about the two-stage gear unit 22*c* at the same angular velocity as the input gear.

The large-diameter gear 22*d* is provided immediately downstream from the two-stage gear unit 22*c*. In the present embodiment, the large-diameter gear 22*d* is provided at the lowermost stream of the transmission mechanism 22. The large-diameter gear 22*d* meshes with the output gear of the two-stage gear unit 22*c*, so as to be rotated about its own shaft by the drive force transmitted by the output gear.

The joint member 23 has an approximately cylindrical shape. The joint member 23 is fixed at one end to the shaft of the large-diameter gear 22*d*. Moreover, the joint member 23 has a protrusion or a groove formed at the other end. The joint member 23 is rotated at the same rotational speed as the large-diameter gear 22*d*.

The coupling member 24 has an approximately cylindrical shape. The coupling member 24 has a protrusion or a groove formed at one end so that it can engage with the protrusion or groove of the joint member 23. Moreover, the coupling member 24 is fixed at the other end to the rotating shaft of the photoreceptor drum 110.

With the above configuration, the drive force generated by the motor 21 is transmitted to the photoreceptor drum 110 via the transmission mechanism 22, the joint member 23, and the coupling member 24. The photoreceptor drum 110 is rotated at a predetermined rotational speed by the drive force transmitted thereto.

Such a drive system has a problem in that non-uniform rotation (i.e., a variation in rotational speed) occurs due to the vibration generated by meshing of the gears 22*a* to 22*d* in the transmission mechanism 22 and also due to the vibration per rotational cycle of the photoreceptor drums 110.

To suppress such non-uniform rotation, the drive system includes an encoder 25, a hinge member 26, a piezoelectric element 27, which is a typical example of an actuator, and a control circuit 28, as shown in FIGS. 2 and 3.

The encoder 25 is a sensor that outputs a signal indicating the rotational status of the photoreceptor drum 110. More specifically, the encoder 25 outputs a signal indicating non-uniform rotation for a rotational cycle of the photoreceptor drum 110. The encoder 25 thus configured is attached to the rotating shaft of the photoreceptor drum 110.

The hinge member 26 is a plate-like member having a predetermined shape (in the example of FIG. 2, oval). The hinge member 26 has a first through-hole 26*a* and a second through-hole 26*b* provided therein, the first through-hole 26*a* has approximately the same diameter as the shaft of the large-diameter gear 22*d* located on the downstream side, and the second through-hole 26*b* has approximately the same diameter as the shaft of the two-stage gear unit 22*c* located upstream from the large-diameter gear 22*d*. The first through-hole 26*a* has the shaft of the large-diameter gear 22*d* inserted therein. Moreover, the second through-hole 26*b* has the shaft of the two-stage gear unit 22*c* inserted therein. Here, the shaft of the large-diameter gear 22*d* is not fixed to the first through-hole 26*a*, and the shaft of the two-stage gear unit 22*c* is not fixed to the second through-hole 26*b*.

The piezoelectric element 27 is, for example, of a laminated type, and it extends and contracts in the direction of the lamination upon application of a voltage. Here, the amount of extension/contraction of the piezoelectric element 27 is about 5 μm. The piezoelectric element 27 is preferably positioned as described below. The piezoelectric element 27 is fixed at one end in the direction of the lamination to, for example, the frame of the image forming apparatus. Moreover, the piezoelectric element 27 is fixed at the other end in the direction of the lamination to the hinge member 26. In addition, the piezoelectric element 27 is oriented so as to extend and contract in direction γ perpendicular to line β extending between the centers of the through-holes 26*a* and 26*b*.

By positioning the piezoelectric element 27 as above, the hinge member 26 vibrates clockwise or counterclockwise about the shaft of the large-diameter gear 22*d*, as indicated by arrow 8, in synchronization with the extension and contraction of the piezoelectric element 27. The vibration instantaneously strengthens or weakens the force with which the teeth of the output gear of the two-stage gear unit 22*c* push the teeth of the large-diameter gear 22*d*. This instantaneously accelerates or decelerates the rotational speed of the large-diameter gear 22*d*, hence the rotational speed of the photoreceptor drum 110. Here, in the case where the amount of extension/contraction of the piezoelectric element 27 is about 5 μm, the photoreceptor drum 110 is rotated instantaneously faster or slower within the range of ±1 μm in the rotational direction.

The control circuit 28 is configured by a processor, random-access memory (RAM), etc. To suppress non-uniform rotation, the control circuit 28 receives an output signal from the encoder 25. From the received signal, the control circuit 28 reads information about non-uniform rotation for a rotational cycle of the photoreceptor drum 110. The control circuit 28 generates a control signal in opposite phase to the non-uniform rotation according to the obtained information, and applies the signal to the piezoelectric element 27.

Note that the control signal does not have to be in complete opposite phase to non-uniform rotation, and it simply deals with non-uniform rotation so that the actuator (i.e., the piezoelectric element 27) can eliminate the non-uniform rotation substantially. This also applies to second through fifth configuration examples to be described later.

Furthermore, the control signal may be updated every rotational cycle of the photoreceptor drum 110, or it may be left unupdated for more than one rotation for which the degree of non-uniform rotation can be considered completely insignificant.

Operation of First Configuration Example

In the present drive system, because of the positions of the hinge member 26 and the piezoelectric element 27, as well as the control signal from the control circuit 28, the transmission mechanism 22 experiences a rotational variation in opposite phase to non-uniform rotation for a rotational cycle of the photoreceptor drum 110. As a result, the non-uniform rotation of the photoreceptor drum 110 can be cancelled out by the rotational variation caused to the transmission mechanism 22, leading to suppression of the non-uniform rotation of the photoreceptor drum 110.

Here, it is assumed that none of the hinge member 26, the piezoelectric element 27, and the control signal is provided. In such a case, the teeth of the output gear in the two-stage gear unit mesh with the teeth of the large-diameter gear without jostling or coming out of contact with each other, as shown at the top right panel of FIG. 4. Moreover, as illustrated at the top center panel of FIG. 4, non-uniform rotation (a variation in rotational speed) might occur every rotational cycle of the photoreceptor drum.

Figure 4:
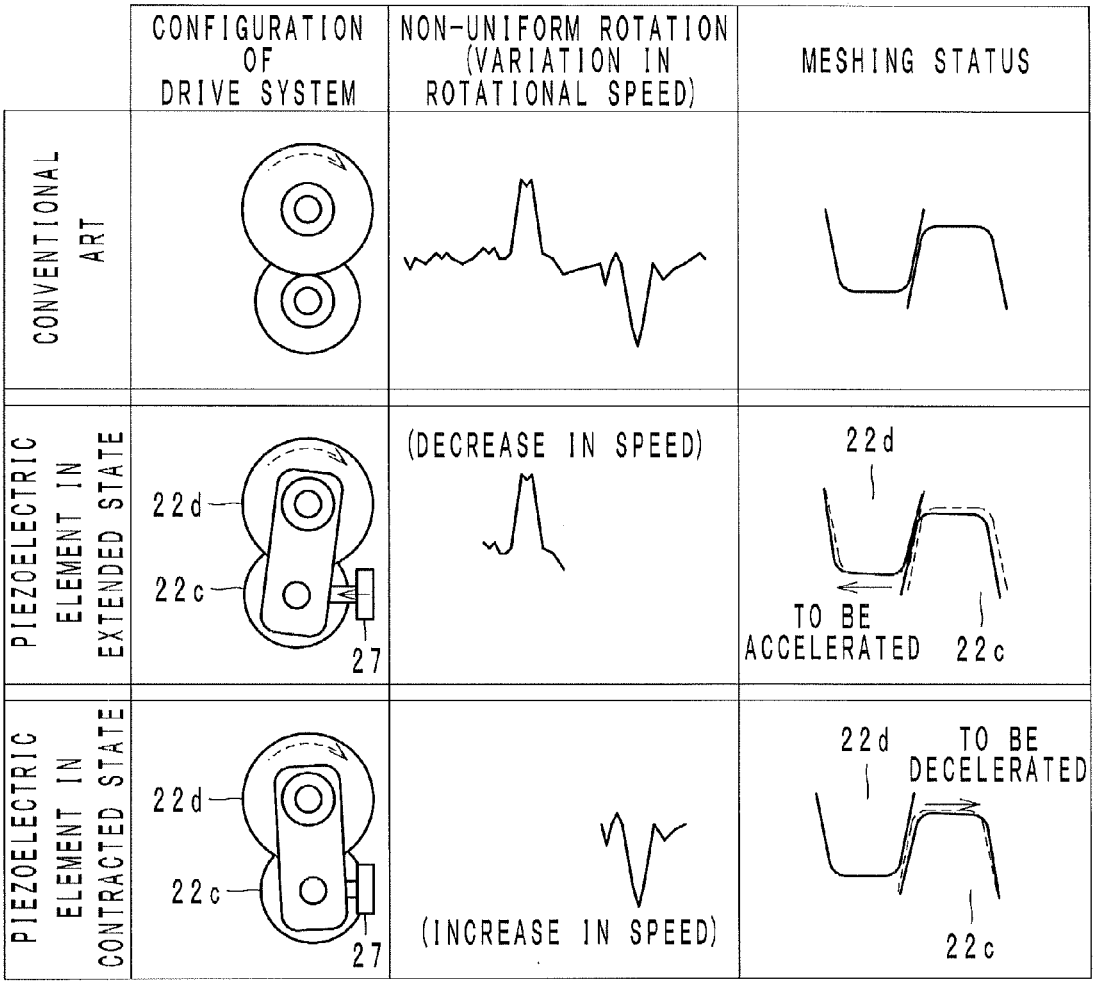
FIG. 4 is a diagram outlining the operation of the drive system in FIG. 2

On the other hand, in the case of the drive system shown in FIGS. 2 and 3, when the rotational speed of the photoreceptor drum 110 is slowed, as shown at the middle center panel of FIG. 4, the control circuit 28 causes the piezoelectric element 27 to extend (see the middle left panel of FIG. 4) by applying a control signal thereto, thereby rotating the hinge member 26. This strengthens the force with which a tooth of the output gear located on the upstream side presses a tooth of the large-diameter gear 22*d* located on the downstream side (see the middle right panel of FIG. 4), thereby eliminating the delay in the rotational speed of the photoreceptor drum 110.

Assuming here that the rotation angle of the large-diameter gear 22*d* is Y, and the rotation angle of the hinge member 26 is X, Y is represented by equation (1) below:

$$Y=(Z4/Z3)\cdot(Z2/Z1)\cdot X \quad (1),$$

where Z1 is the number of teeth of the large-diameter gear 22*d*, Z2 is the number of teeth of the output gear in the two-stage gear unit 22*c*, Z3 is the number of teeth of the input gear in the two-stage gear unit 22*c*, and Z4 is the number of teeth of the small-diameter gear 22*b*.

In the case where there is an increase in the rotational speed of the photoreceptor drum 110, as illustrated at the bottom center panel of FIG. 4, the control circuit 28 causes the piezoelectric element 27 to contract (see the bottom left panel of FIG. 4) by applying a control signal thereto, thereby weakening the force with which a tooth of the output gear located on the upstream side presses a tooth of the large-diameter gear 22*d* located on the downstream side (see the bottom right panel of FIG. 4). This eliminates the increase in the rotational speed of the photoreceptor drum 110.

Note that in the state shown at the bottom right panel of FIG. 4, the weakening of the pressing force results in the tooth of the output gear located on the upstream side coming out of contact with the tooth of the large-diameter gear 22*d* located on the downstream side, so that the pressing force is reduced instantaneously to zero.

Effects

Figure 5:
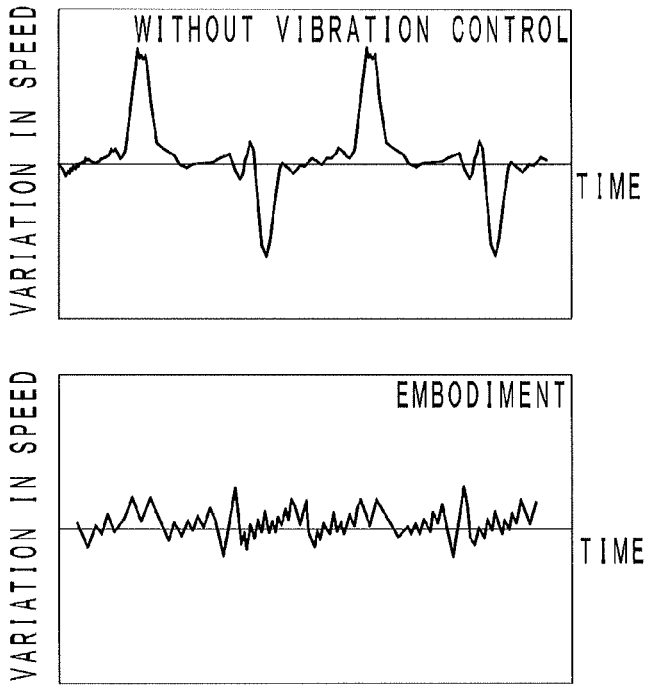
FIG. 5 is a diagram illustrating suppression of non-uniform rotation of the photoreceptor drum.

Drive systems without vibration control are prone to non-uniform rotation (a variation in speed) every rotational cycle of the photoreceptor drum, as shown at the top panel of FIG. 5. However, by equipping the image forming apparatus with the drive system described above, it is rendered possible to suppress non-uniform rotation every rotational cycle of the photoreceptor drum 110, as shown at the bottom panel of FIG. 5.

Figure 6:
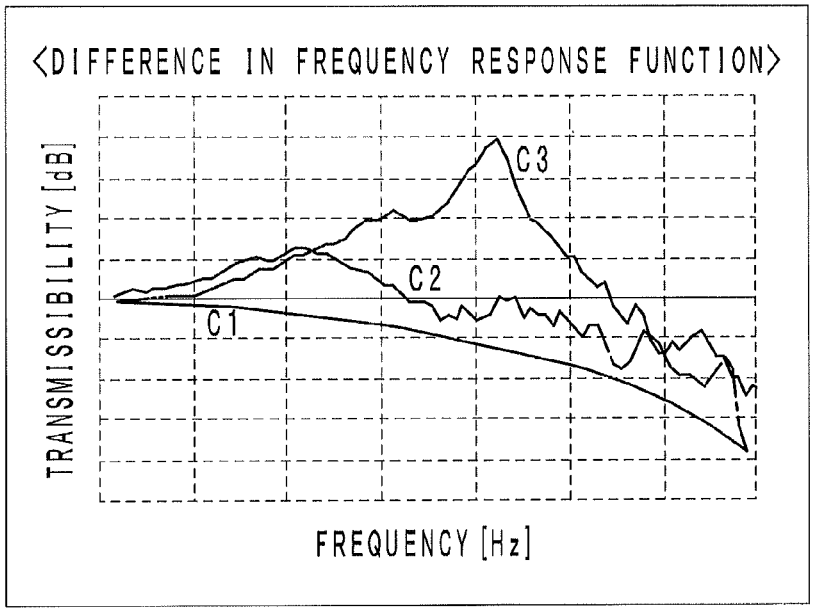
FIG. 6 is a graph showing frequency response functions for the drive system in FIG. 2, a conventional drive system, and a drive system without vibration control.

Furthermore, in general, the drive system has such a frequency characteristic that the level of vibration transmission varies depending on an input vibration frequency. A quantified version of such a frequency characteristic is called a frequency response function. In the frequency response function, the frequency at which the level of vibration transmission is maximized is a resonant frequency, and the level of vibration transmission at the resonant frequency is called resonance magnification. FIG. 6 is a graph showing frequency response functions where inputs are vibrations of the motor, and outputs are vibrations of the photoreceptor drum. In the figure, curve C1 represents the frequency response function for the drive system of the present embodiment, curve C2 represents the frequency response function for a conventional drive system with passive vibration control, and curve C3 represents the frequency response function for a drive system without vibration control.

In the case of the drive system without vibration control, the level of vibration transmission for the drive system peaks at the resonant frequency, as indicated by curve C3. For the conventional drive system with passive vibration control, for example, the resonant frequency of the drive system is shifted to the lower side of the frequency, and the level of vibration transmission is reduced, as indicated by curve C2. Accordingly, upon input of vibration that is not expected by design, the passive vibration control, in some cases, might not be able to suppress the vibration completely. On the other hand, as for the drive system of the present embodiment indicated by curve C1, the control circuit 28 reads information about non-uniform rotation of the photoreceptor drum 110 from an output signal of the encoder 25. Through the piezoelectric element 27, the control circuit 28 provides the transmission mechanism 22 with a rotational variation in opposite phase to the non-uniform rotation according to the obtained information. As a result, the image forming apparatus can appropriately suppress vibration within a wide range of frequencies.

Furthermore, for the present drive system, vibration control is performed by a simple configuration using the encoder 25, the piezoelectric element 27, and the control circuit 28, which can contribute to cost reduction of the image forming apparatus.

Second Configuration Example of Drive System

Figure 7:
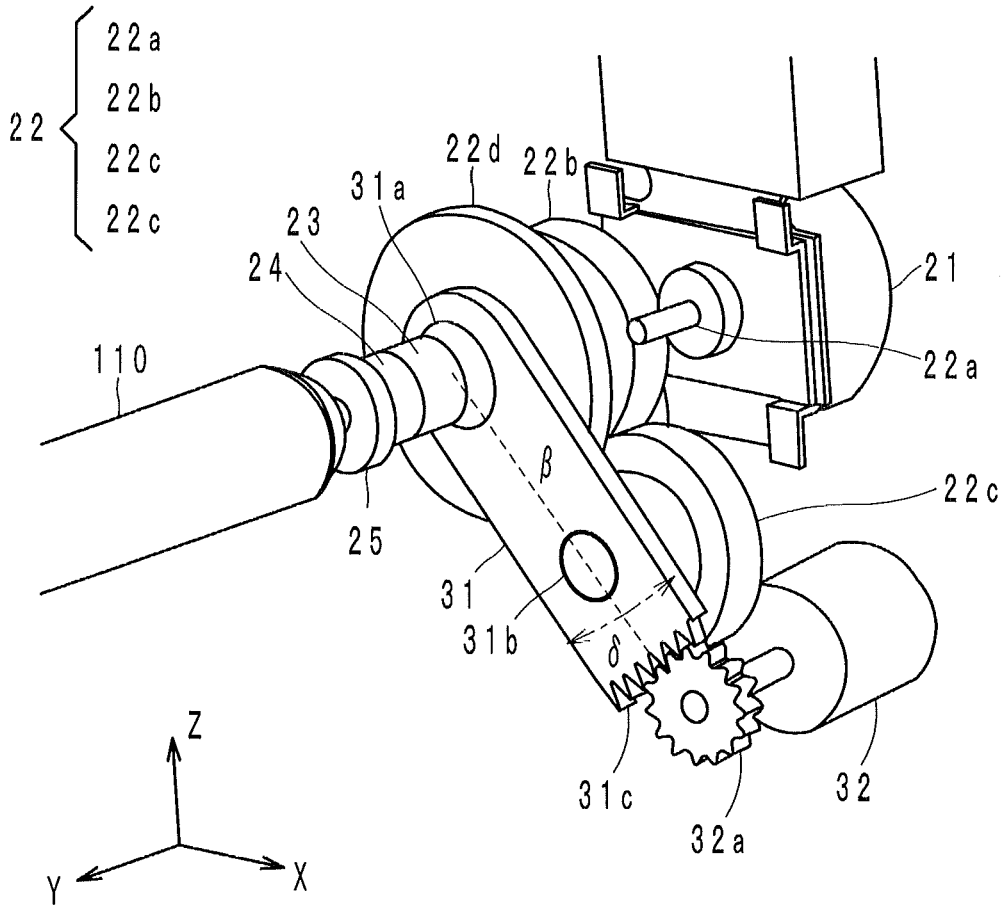
FIG. 7 is an oblique view illustrating a second configuration example of the drive system for the photoreceptor drum in FIG. 1.
Figure 8:
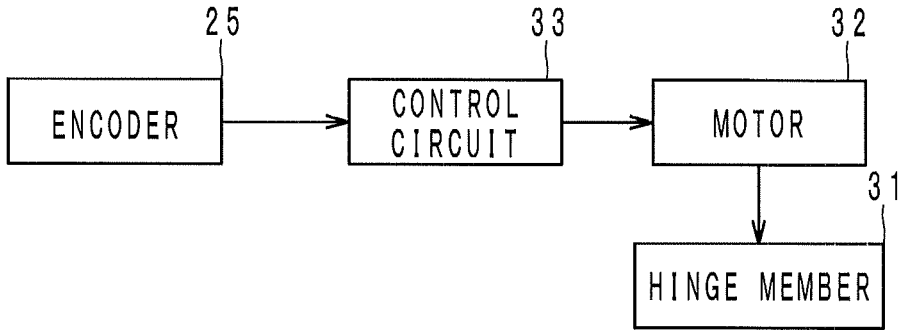
FIG. 8 is a block diagram illustrating the configuration of a substantial part of the drive system in FIG. 7.

FIG. 7 is an oblique view of a second configuration example of the drive system for the photoreceptor drum 110 shown in FIG. 1. FIG. 8 is a block diagram illustrating the configuration of a substantial part of the drive system in FIG. 7.

The second configuration example shown in FIG. 7 differs from the first configuration example shown in FIG. 2 in that a hinge member 31, a motor 32, which is a typical example of a second drive source, and a control circuit 33 are provided in place of the hinge member 26, the piezoelectric element 27, and the control circuit 28. Since there is no other difference between these configuration examples, elements in FIG. 7 that correspond to those in FIG. 2 are denoted by the same reference numerals, and any descriptions thereof will be omitted.

The hinge member 31 is a plate-like member having a predetermined shape. The hinge member 31 has a first through-hole 31*a* and a second through-hole 31*b* provided therein, the first through-hole 31*a* has inserted therein the shaft of the large-diameter gear 22*d* located on the downstream side, and the second through-hole 31*b* has inserted therein the shaft of the two-stage gear unit 22*c* located upstream from the large-diameter gear 22*d*. The shaft of the large-diameter gear 22*d* is not fixed to the first through-hole 31*a*, and the shaft of the two-stage gear unit 22*c* is not fixed to the second through-hole 31*b*.

Here, the direction from the center of the through-hole 31*a* toward the center of the through-hole 31*b* is denoted by β. The hinge member 31 is toothed at the edge in direction β. The toothed edge will be referred to below as a rack gear 31*c*.

The motor 32 is preferably an ultrasonic motor, assuming that the drive system receives high-frequency vibration. The motor 32 rotates its own rotating shaft in response to a control signal from the control circuit 33. The rotating shaft has a gear 32*a* provided thereon. The gear 32*a* meshes with the rack gear 31*c*. Here, for the dimensions and the number of teeth, the gear 32*a* and the rack gear 31*c* are designed to have values such that the photoreceptor drum 110 can be rotated faster or slower within the range of about 1 μm in the rotational direction.

With the above configuration, the hinge member 31 pivots clockwise or counterclockwise on the shaft of the large-diameter gear 22*d*, as indicated by arrow δ, in synchronization with the forward or backward rotation of the motor 32. This pivoting action instantaneously accelerates or decelerates the rotational speed of the photoreceptor drum 110 in the same manner as described in conjunction with the first configuration example.

The control circuit 33 is configured by a processor, RAM, etc. To suppress non-uniform rotation, the control circuit 33 generates a control signal in opposite phase to non-uniform rotation for a rotational cycle of the photoreceptor drum 110, on the basis of an output signal from the encoder 25, and the control circuit 33 outputs the generated signal to the motor 32.

Operation and Effects of Second Configuration Example

In the present drive system, through the hinge member 31 and the motor 32, the transmission mechanism 22 receives a rotational variation in opposite phase to non-uniform rotation for a rotational cycle of the photoreceptor drum 110, in accordance with the control signal from the control circuit 33. Thus, as in the first configuration example, the non-uniform rotation of the photoreceptor drum 110 can be cancelled out by the rotational variation caused to the transmission mechanism 22, leading to suppression of the non-uniform rotation of the photoreceptor drum 110.

Third Configuration Example of Drive System

Figure 9:
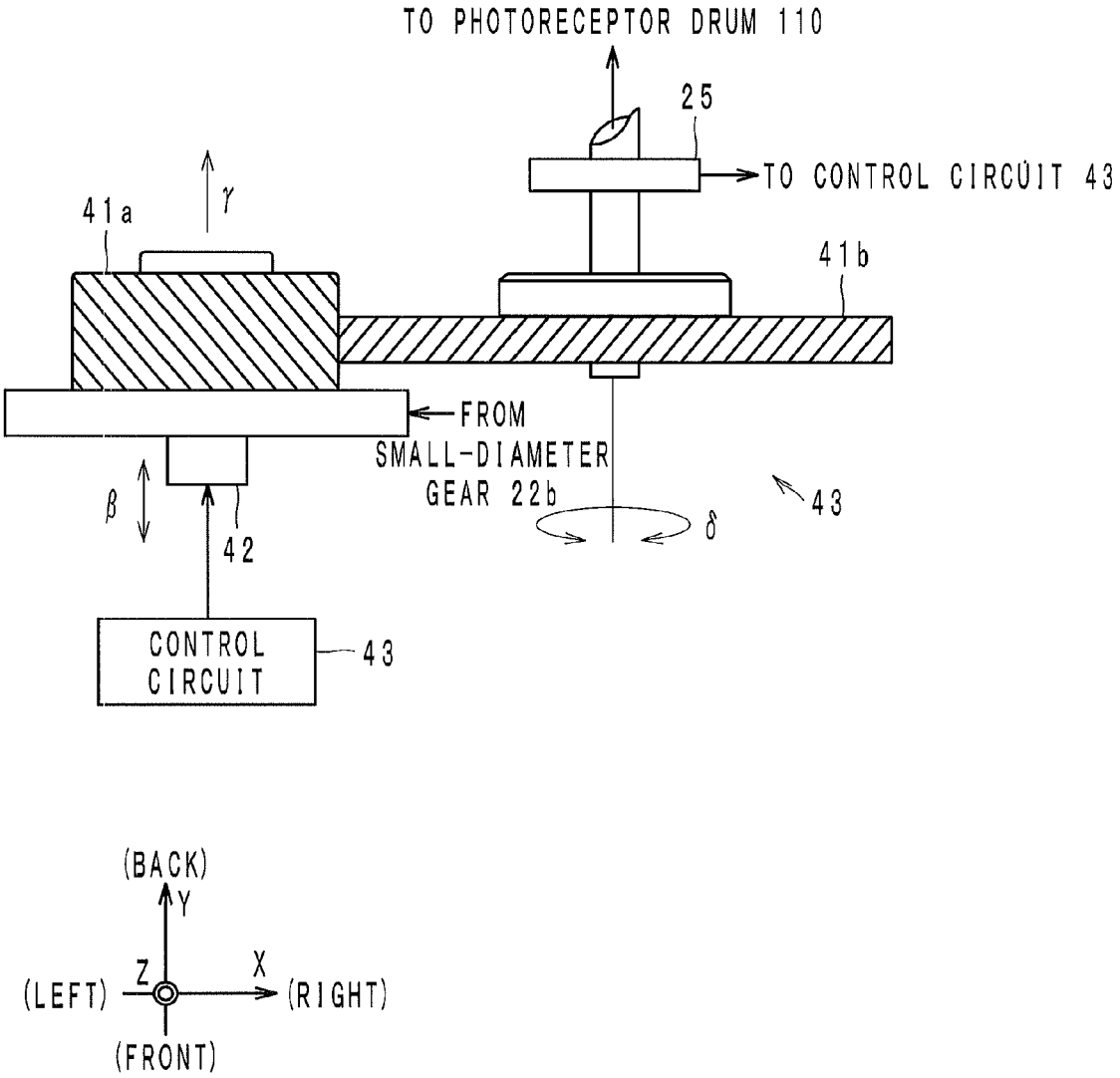
FIG. 9 is a diagram illustrating a third configuration example of the drive system for the photoreceptor drum in FIG. 1.

FIG. 9 is a diagram illustrating a substantial part of a third configuration example of the drive system for the photoreceptor drum 110 shown in FIG. 1. The third configuration example shown in FIG. 9 differs from the first configuration example shown in FIG. 2 in that a transmission mechanism 41, a piezoelectric element 42, and a control circuit 43 are provided in place of the transmission mechanism 22, the hinge member 26, the piezoelectric element 27, and the control circuit 28. Since there is no other difference between these configuration examples, elements in FIG. 9 that correspond to those in FIG. 2 are denoted by the same reference numerals, and any descriptions thereof will be omitted. Note that FIG. 9 shows a top view of the transmission mechanism 41 and the piezoelectric element 42.

The transmission mechanism 41 differs from the transmission mechanism 22 in FIG. 2 in structure, and includes a two-stage gear unit 41*a* and a large-diameter gear 41*b* in place of the two-stage gear unit 22*c* and the large-diameter gear 22*d* of the transmission mechanism 22.

The two-stage gear unit 41*a* has an input gear and an output gear. The input gear and the output gear are provided coaxially with each other. The input gear meshes with the small-diameter gear 22*b* provided upstream therefrom, and is caused to rotate about the shaft of the two-stage gear unit 41*a* by a drive force transmitted from the small-diameter gear 22*b*. On the other hand, the output gear is a helical gear that rotates about the shaft of the two-stage gear unit 41*a* at the same angular velocity as the input gear. The two-stage gear unit 41*a* thus configured is attached to, for example, the frame of the image forming apparatus so that it can be displaced in the direction of the rotating shaft. The amount of such displacement is about 5 μm.

The large-diameter gear 42*b* is a helical gear that meshes with the output gear of the two-stage gear unit 41*a* provided upstream therefrom and is caused to rotate about its own shaft by a drive force transmitted from the output gear. Here, the large-diameter gear 42*b* is attached to, for example, the frame of the image forming apparatus, such that, unlike the two-stage gear unit 41*a*, it cannot be displaced in the direction of its own rotating shaft.

The piezoelectric element 42 is, for example, of a laminated type, and it extends and contracts in the direction of the lamination (indicated by arrow β in the figure) upon application of a voltage. The amount of extension/contraction of the piezoelectric element 42 is about 5 μm. The piezoelectric element 42 thus configured is preferably positioned as described below. The piezoelectric element 42 is fixed at one end in the direction of the lamination to, for example, the frame of the image forming apparatus. Moreover, the piezoelectric element 42 is fixed at the other end in the direction of the lamination to the two-stage gear unit 41*a*. In addition, the piezoelectric element 42 is oriented so as to extend and contract in the direction of the rotating shaft of the two-stage gear unit 41*a* (the direction of arrow γ).

With the above configuration, the two-stage gear unit 41*a* vibrates in the direction of its own rotational shaft, in synchronization with the extension and contraction of the piezoelectric element 42. Due to this vibration, the tooth of the output gear in the two-stage gear unit 41*a* located on the upstream side instantaneously pushes the tooth of the large-diameter gear 41*b* located downstream therefrom, in the rotational direction of the large-diameter gear 41*b*, or it instantaneously comes out of contact therewith. Note that the displacement of the large-diameter gear 41*b* in the direction of the rotating shaft is restricted. Consequently, the foregoing action instantaneously accelerates or decelerates the rotational speed of the large-diameter gear 41*b*, hence the rotational speed of the photoreceptor drum 110. In this manner, in the third configuration example, as in the first configuration example, the rotational speed of the photoreceptor drum 110 is accelerated or decelerated instantaneously.

The control circuit 43 is configured by a processor, RAM, etc. To suppress non-uniform rotation, the control circuit 43 generates a control signal in opposite phase to non-uniform rotation for a rotational cycle of the photoreceptor drum 110, on the basis of an output signal from the encoder 25, and the control circuit 43 applies the generated signal to the piezoelectric element 42.

Operation and Effects of Third Configuration Example

In the present drive system, through the piezoelectric element 42, the transmission mechanism 41 receives a rotational variation in opposite phase to non-uniform rotation for a rotational cycle of the photoreceptor drum 110, in accordance with the control signal from the control circuit 43. Thus, as in the first configuration example, the non-uniform rotation of the photoreceptor drum 110 can be cancelled out by the rotational variation caused to the transmission mechanism 41, leading to suppression of the non-uniform rotation of the photoreceptor drum 110.

Fourth Configuration Example of Drive System

Figure 10:
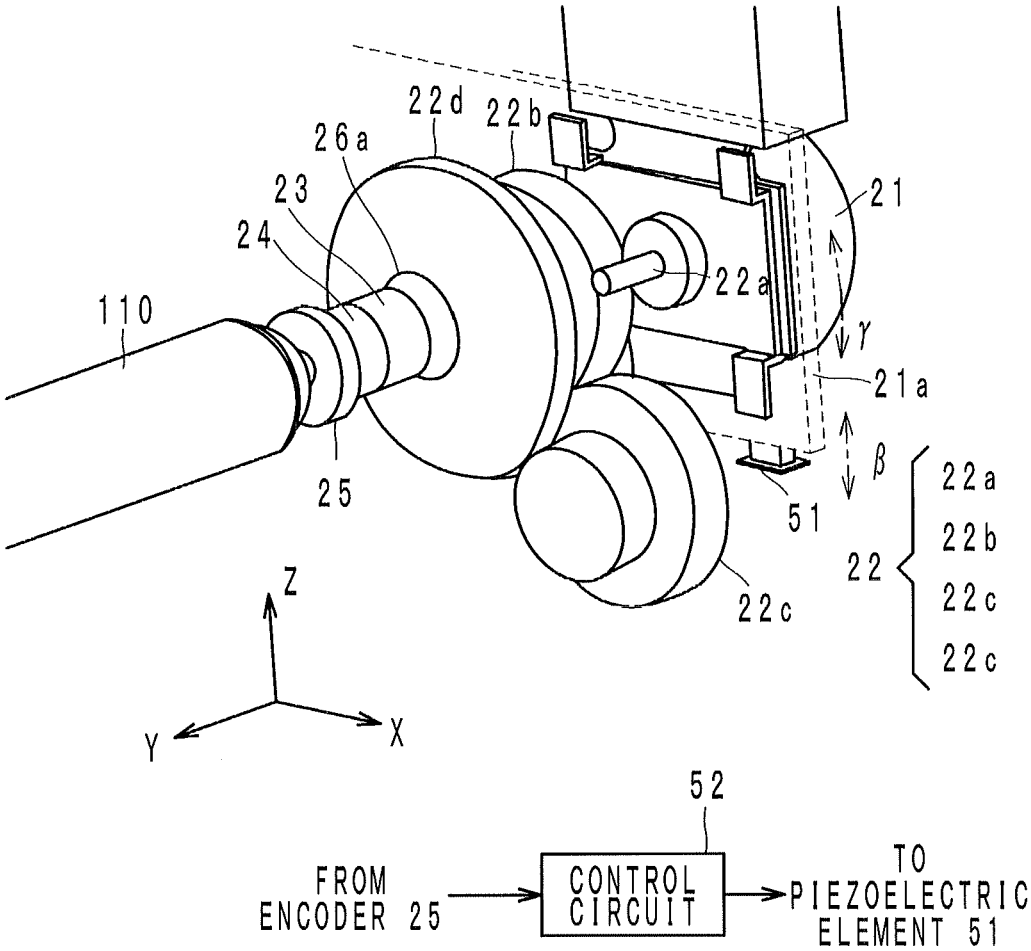
FIG. 10 is a diagram illustrating a substantial part of a fourth configuration example of the drive system for the photoreceptor drum in FIG. 1.

FIG. 10 is a diagram illustrating a substantial part of a fourth configuration example of the drive system for the photoreceptor drum 110 shown in FIG. 1. The fourth configuration example shown in FIG. 10 differs from the first configuration example shown in FIG. 2 in that a piezoelectric element 51 and a control circuit 52 are provided in place of the hinge member 26, the piezoelectric element 27, and the control circuit 28. Since there is no other difference between these configuration examples, elements in FIG. 10 that correspond to those in FIG. 2 are denoted by the same reference numerals, and any descriptions thereof will be omitted.

The piezoelectric element 51 is, for example, of a laminated type, and it extends and contracts in the direction of the lamination (indicated by arrow β in the figure) upon application of a voltage. The amount of extension/contraction of the piezoelectric element 51 is about 5 μm. The piezoelectric element 51 thus configured is preferably positioned as described below. The piezoelectric element 51 is fixed at one end in the direction of the lamination to, for example, the frame of the image forming apparatus. Moreover, the piezoelectric element 51 is fixed at the other end in the direction of the lamination to an attachment plate 21*a* of the motor 21.

With the above configuration, the attachment plate 21*a* pivots on the rotating shaft of the small-diameter gear 22*b* provided downstream from the gear 22*a*, in synchronization with the extension and contraction of the piezoelectric element 51. Due to this pivoting action, the tooth of the gear 22*a* located on the upstream side instantaneously pushes the tooth of the small-diameter gear 22*b* located downstream therefrom, in the rotational direction of the small-diameter gear 22*b*, or it instantaneously comes out of contact therewith. The variation in speed of the small-diameter gear 22*b* due to such vibration is transmitted to the large-diameter gear 22*d*, and further to the photoreceptor drum 110. As a result, the rotational speed of the photoreceptor drum 110 is accelerated or decelerated instantaneously. In other words, in the fourth configuration example, the rotational speed of the photoreceptor drum 110 is accelerated or decelerated instantaneously, in the same manner as described in conjunction with the first configuration example.

The control circuit 52 is configured by a processor, RAM, etc. To suppress non-uniform rotation, the control circuit 52 generates a control signal in opposite phase to non-uniform rotation for a rotational cycle of the photoreceptor drum 110, on the basis of an output signal from the encoder 25, and the control circuit 52 applies the generated signal to the piezoelectric element 51.

Operation and Effects of Fourth Configuration Example

In the present drive system, through the piezoelectric element 51, the transmission mechanism 22 receives a rotational variation in opposite phase to non-uniform rotation for a rotational cycle of the photoreceptor drum 110, in accordance with the control signal from the control circuit 52. Thus, as in the first configuration example, the non-uniform rotation of the photoreceptor drum 110 can be cancelled out by the rotational variation caused to the transmission mechanism 22, leading to suppression of the non-uniform rotation of the photoreceptor drum 110.

Fifth Configuration Example of Drive System

Figure 11:
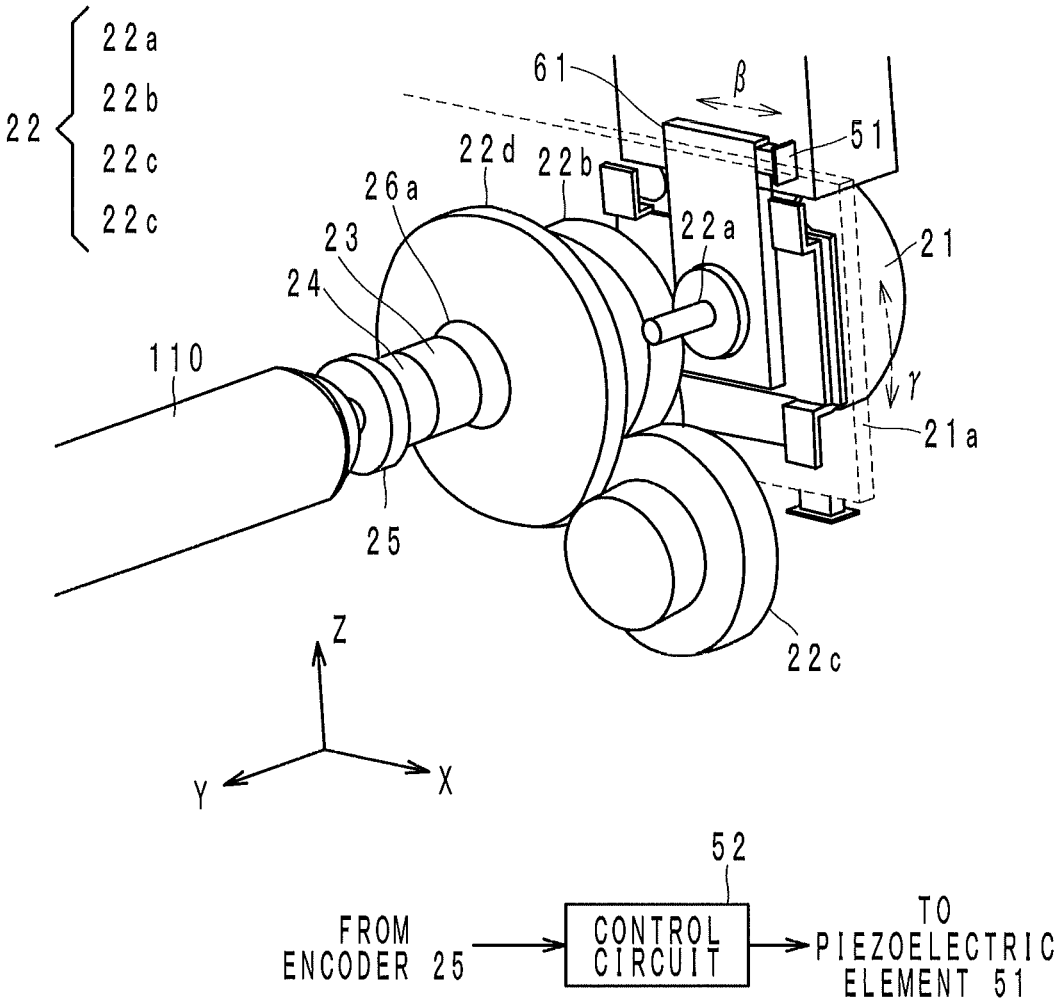
FIG. 11 is a diagram illustrating a substantial part of a fifth configuration example of the drive system for the photoreceptor drum in FIG. 1.

In the fourth configuration example, the piezoelectric element 51 extends and contracts to vibrate the attachment plate 21*a* of the motor 21. However, this is not restrictive, and the piezoelectric element 51 may vibrate a hinge member 61 fixed to the attachment plate 21*a*, as shown in FIG. 11. In this case also, non-uniform rotation of the photoreceptor drum 110 can be suppressed, as in the fourth configuration example.

Supplementary

The foregoing has been described with respect to suppression of non-uniform rotation of the photoreceptor drum 110, which is a typical example of the rotating member. However, a similar technical problem might occur to the intermediate transfer belt 14 with a toner image supported thereon. Accordingly, each of the above configuration examples may be provided to suppress non-uniform rotation of the intermediate transfer belt 14, which is another example of the rotating member.

Although the present invention has been described in connection with the preferred embodiment above, it is to be noted that various changes and modifications are possible to those who are skilled in the art. Such changes and modifications are to be understood as being within the scope of the invention.

What is claimed is:

1. An image forming apparatus comprising:

a rotating member adapted to support an image;

a first drive source configured to generate a drive force;

a transmission mechanism configured to transmit the drive force generated by the first drive source toward the rotating member, the mechanism including an upstream gear and a downstream gear configured to receive the drive force from the upstream gear;

a sensor configured to output a signal indicating a rotational status of the rotating member;

a control circuit configured to generate a control signal appropriate for non-uniform rotation of the rotating member, on the basis of the signal outputted by the sensor; and an actuator configured to cause a rotation axis of the first drive source or the transmission mechanism to pivot, in accordance with the control signal generated by the control circuit, thereby changing a force with which the upstream gear pushes the downstream gear into rotation such that the non-uniform rotation of the rotating member is cancelled out.

2. The image forming apparatus according to claim 1, further comprising a hinge member provided with a first through-hole in which a rotating shaft of the downstream gear is inserted and a second through-hole in which a rotating shaft of the upstream gear is inserted, wherein, the actuator is fixed to the hinge member, and makes a translatory movement upon application of the control signal from the control circuit, thereby causing the upstream gear to pivot on the rotating shaft of the downstream gear, so that the force with which the upstream gear pushes the downstream gear into rotation is changed.

3. The image forming apparatus according to claim 1, further comprising a hinge member provided with a first through-hole in which a rotating shaft of the downstream gear is inserted and a second through-hole in which a rotating shaft of the upstream gear is inserted, wherein, the actuator includes:

a rack gear formed at an edge of the hinge member that is perpendicular to a line extending between rotational centers of the downstream gear and the upstream gear; and a second drive source that has a rotating shaft with a gear adapted to mesh with the rack gear and rotates the rotating shaft in response to the control signal from the control circuit.

4. The image forming apparatus according to claim 1, wherein, the upstream gear and the downstream gear are helical gears, and the actuator is fixed to the upstream gear, and makes a translatory movement upon application of the control signal from the control circuit, thereby causing the upstream gear to pivot in a direction of its own rotating shaft, so that the force with which the upstream gear pushes the downstream gear into rotation is changed.

5. The image forming apparatus according to claim 1, wherein, the upstream gear is attached to a rotating shaft of the first drive source, the downstream gear meshes with a gear of the first drive source, and the actuator makes a translatory movement upon application of the control signal from the control circuit, thereby causing the gear of the first drive source to pivot on the rotating shaft of the downstream gear, so that the force with which the upstream gear pushes the downstream gear into rotation is changed.

6. The image forming apparatus according to claim 1, wherein the actuator is provided downstream of the transmission mechanism.

7. The image forming apparatus according to claim 1, wherein the actuator is provided between the transmission mechanism and the rotating member.

* * * * *